US005857820A

United States Patent [19]

Perazzolo

[11] Patent Number: 5,857,820

[45] Date of Patent: Jan. 12, 1999

[54] SHEET METAL-WORKING MACHINE

[75] Inventor: Eugenio Perazzolo, Rovigo, Italy

[73] Assignee: Rainer S.r.l., Calderara Di Reno, Italy

[21] Appl. No.: 821,678

[22] Filed: Mar. 20, 1997

[30] Foreign Application Priority Data

Mar. 20, 1996 [IT] Italy ..... B096 A 0154

[51] Int. Cl.[6] ..... B23Q 3/02

[52] U.S. Cl. ..... 414/16; 198/468.2; 294/81.2; 294/81.6

[58] Field of Search ..... 414/16, 17, 18, 414/19, 749–753; 294/87.1, 65, 81.2, 81.6; 198/468.3, 468.2; 83/412–414

[56] References Cited

U.S. PATENT DOCUMENTS

| | | | |
|---|---|---|---|
| 3,860,280 | 1/1975 | Karlsson | 294/65 X |
| 4,143,571 | 3/1979 | Oxenham . | |
| 4,669,346 | 6/1987 | Benedict . | |
| 5,575,376 | 11/1996 | Colamussi | 294/65 X |

FOREIGN PATENT DOCUMENTS

| | | |
|---|---|---|
| 941554U | 11/1994 | Germany . |
| 02104428A | 4/1990 | Japan . |
| 04367340A | 12/1992 | Japan . |
| 05138273A | 6/1993 | Japan . |

*Primary Examiner*—Donald W. Underwood
*Attorney, Agent, or Firm*—Birch, Stewart, Kolasch & Birch, LLP

[57] ABSTRACT

The machine includes: a worktable on to which a metal sheet is loaded in use; a work station; a member for feeding the sheet along the worktable to and from the work station, the member including a carriage movable along a first horizontal axis, a slide fitted to and movable with respect to the carriage along a second horizontal axis perpendicular to the first axis, and a number of gripper assemblies fitted to the slide and each having a gripper for engaging a peripheral edge of the sheet; and a device for clamping and releasing the gripper assemblies to and from the slide. The machine also includes a positioning device fitted to the slide, and for moving the gripper assembly, with respect to the slide, along an axis parallel to the second axis, to position the gripper assembly as required with respect to the slide; the positioning device including drive means for driving the gripper assembly to be positioned, and a device for transmitting motion from the drive means to the gripper assembly to be positioned.

12 Claims, 7 Drawing Sheets

SHEET METAL-WORKING MACHINE

BACKGROUND OF THE INVENTION

1 . Field of the Invention

The present invention relates to a sheet metal-working machine.

As is known sheet metal-working machines substantially comprise a worktable; a work station; and a member for feeding a metal sheet along the worktable to and from the work station. The feed member comprises a carriage traveling along a horizontal axis Y; a slide fitted to the carriage and movable along a horizontal axis X perpendicular to the Y axis; and a number of grippers fitted to the slide and for engaging a peripheral edge of the sheet. Each gripper also comprises a member on which the peripheral edge of the sheet engaged by the grippers rests.

2. Description of the Background Art

In actual use, the grippers are positioned with respect to the longitudinal axis of the slide according to the length of the edge of the sheet engaged by the grippers, and the location of the portions of the sheet to be worked. To do which, the machine is stopped, and the operator, by means of manual controls, performs a sequence of operations whereby the gripper is opened, is released from the slide, is moved along the X axis into a predetermined position, is clamped to the slide, and is then closed. All of which operations must, of course, be performed whenever the position of one or more grippers is changed with respect to the slide. Moreover, it frequently happens that the portion of the edge of the sheet engaged by one of grippers must also be worked, in which case, the above operations must be performed twice: the first time to change the position of the gripper, and the second time, after the sheet is worked, to restore the gripper to its original position. The above method of positioning the grippers therefore involves a large amount of time, requiring the assistance of an operator. If moved while located at the work station, the gripper may, as it is moved with respect to the slide, collide, for example, with a tool at the work station.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

SUMMARY OF THE INVENTION

It is an object of the present invention to provide a sheet metal-working machine designed to overcome the aforementioned drawbacks, by featuring a device for automatically moving and positioning the grippers along the slide.

According to the present invention, there is provided a sheet metal-working machine of the type comprising:

a worktable on to which a metal sheet is loaded in use;

a work station;

a feed member for feeding said sheet along said worktable to and from said work station; said member comprising a carriage movable along a first horizontal axis, a slide fitted to and movable with respect to said carriage along a second horizontal axis perpendicular to said first horizontal axis, and a number of gripper assemblies fitted to said slide and each comprising a gripper for engaging a peripheral edge of said sheet; and a first device, for each said gripper assembly, for clamping and releasing one of said gripper assemblies to and from said slide;

characterized by comprising a positioning device fitted to said slide, and for moving a said gripper assembly, with respect to said slide, along an axis parallel to said second axis to position said gripper assembly as required with respect to said slide; said positioning device comprising drive means for driving said gripper assembly to be positioned, and a second device for transmitting motion from said drive means to said gripper assembly to be positioned.

The present invention will become more fully understood from the detailed description given hereinbelow and the accompanying drawings which are given by way of illustration only, and thus are not limitative of the present invention, and wherein:

BRIEF DESCRIPTION OF THE DRAWINGS

A number of non-limiting embodiments of the present invention will be described by way of example with reference to the accompanying drawings, in which.

DETAILED DESCRIPTION OF THE INVENTION

Figure 1:
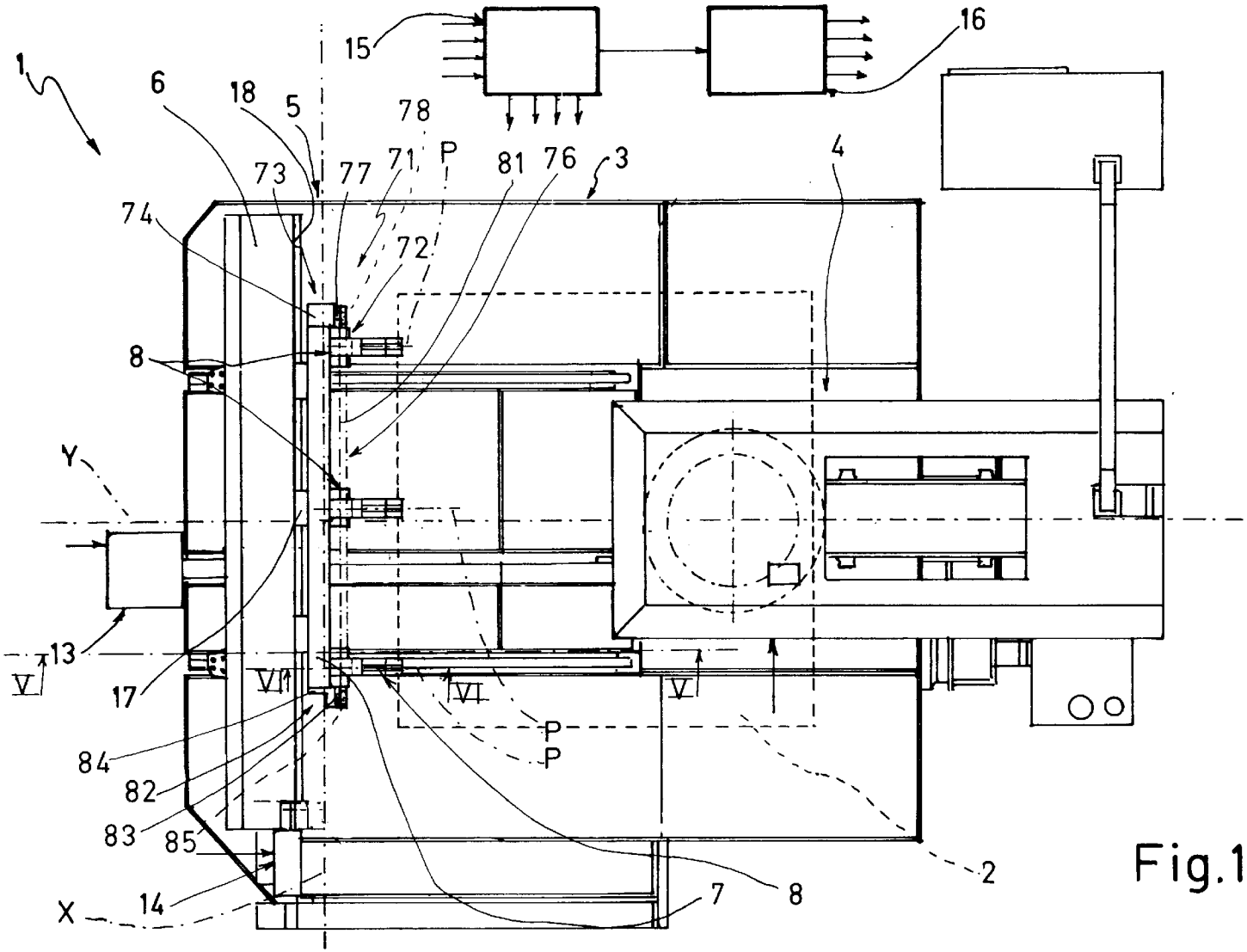
FIG. 1 shows a plan view of a first embodiment of a sheet metal-working machine in accordance with the teachings of the present invention.

Number 1 in FIG. 1 indicates a machine for working metal sheets 2, one of which is indicated by the dotted line. Machine 1 comprises a known worktable 3; a known work station 4 for punching sheet 2; and a member 5 for feeding sheet 2 along worktable 3 to and from work station 4. Member 5 comprises a carriage 6 movable along a horizontal axis Y; a slide 7 fitted to carriage 6 and movable, with respect to carriage 6, along a horizontal axis X perpendicular to the Y axis; and a number of gripper assemblies 8 fitted to slide 7, and each comprising a gripper 9 for engaging a peripheral edge of sheet 2.

For each gripper assembly 8, member 5 also comprises a fluid device 10 (FIG. 6) for closing and opening gripper 9; a fluid device 11 (FIGS. 2 and 6) for rotating gripper 9 about a horizontal axis parallel to the X axis; and a fluid device 12 (FIG. 5) for clamping and releasing gripper assembly 8 to and from slide 7. Finally, member 5 also comprises drive means 13 for controlling the travel of carriage 6 along the Y axis; and drive means 14 for controlling the travel of slide 7 along the X axis; means 13 and 14 being known and installed on the Applicant's machines. An electronic central control unit 15 controls the work cycle of machine 1, in particular work station 4 and means 13 and 14, and, by means of a fluid control system 16, controls fluid devices 10, 11 and 12 and other fluid devices on machine 1.

Carriage 6 is defined by a longitudinal member having a longitudinal axis parallel to the X axis; and slide 7 is also defined by a longitudinal member having a longitudinal axis X, and comprising pads 17, which cooperate with a guide 18 formed along carriage 6 and along which slide 7 travels along the X axis. The face of slide 7 facing work station 4 comprises a groove 19 (FIG. 5) having a T-shaped cross section and a longitudinal axis parallel to the X axis, and which (as explained clearly later on) acts as a guide for positioning gripper assemblies 8, with respect to slide 7, along a horizontal axis parallel to the X axis.

With reference to FIGS. 2 to 5, each gripper assembly 8 comprises a body 21 fitted to slide 7, and which, on the face facing slide 7, supports a bar 22 having a horizontal longitudinal axis parallel to axis X, and engaging groove 19 with a given clearance. More specifically, in section, bar 22 is complementary in shape to groove 19. Viewed from above, body 21 is substantially C-shaped, and comprises a central portion 23 supporting bar 22 and having a horizontal longitudinal axis parallel to the X axis; and two lateral portions 24 extending perpendicularly from portion 23 towards station 4. Two parallel tabs 25 extend upwards from the upper face of central portion 23, and between them support a horizontal pin 26 with an axis parallel to the X axis.

Figure 6:
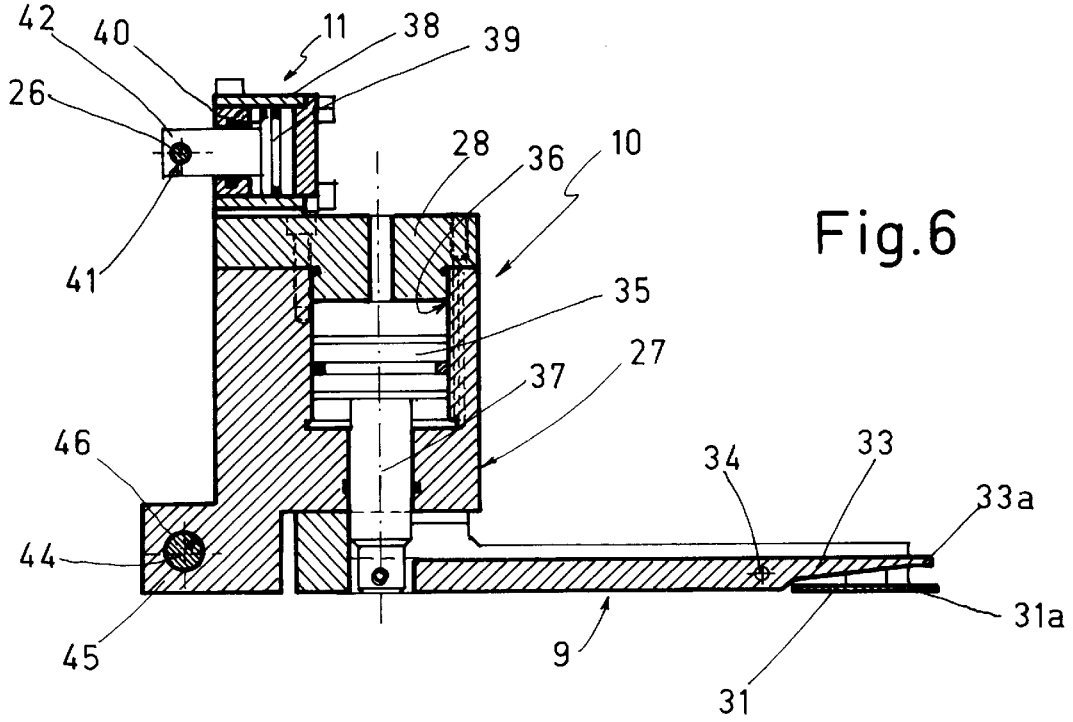
FIG. 6 shows a larger-scale section, with parts removed for clarity, along line VI—VI in FIG. 1.
Figure 2:
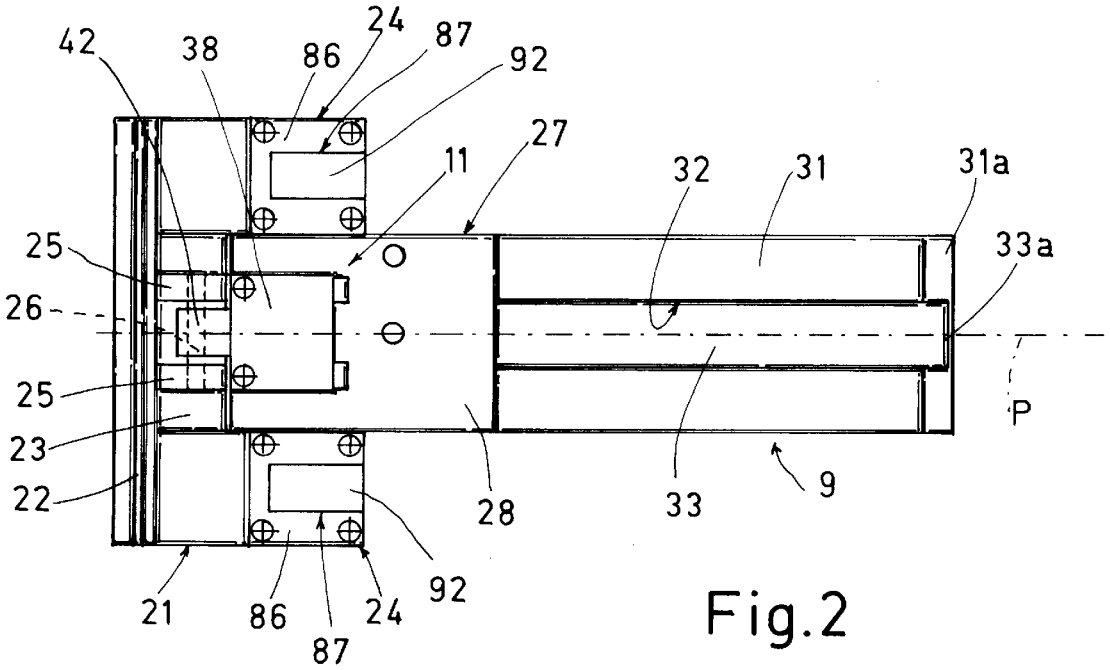
FIG. 2 shows a larger-scale plan view of a gripper assembly of the FIG. 1 machine.
Figure 4:
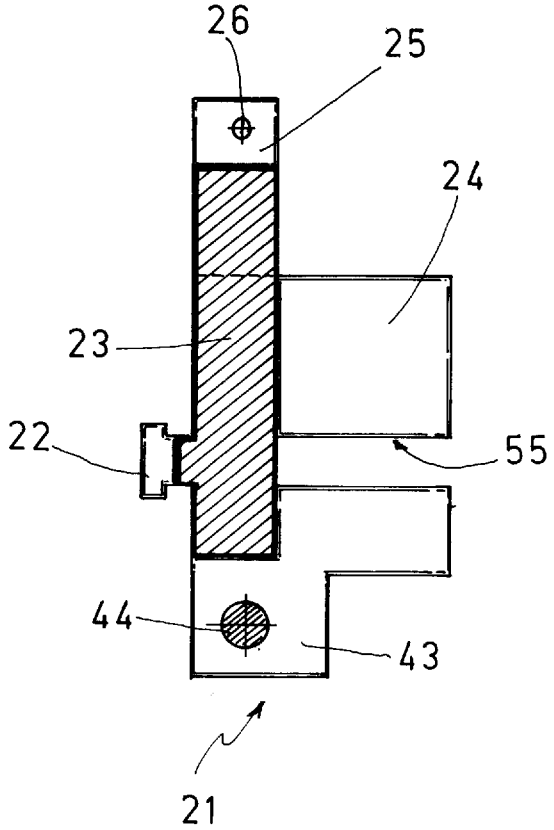
FIG. 4 shows a section along line IV—IV in FIG. 3.

With reference to FIGS. 2 and 6, gripper assembly 8 also comprises a body 27 fitted between lateral portions 24 of body 21, and which supports gripper 9 at the bottom, and a horizontal plate 28 at the top. Each gripper 9 extends along a respective horizontal axis P parallel to the Y axis, and comprises a horizontal plate 31 in which a groove 32 is formed along the P axis, and a central horizontal plate 33 housed inside groove 32; both plates 31 and 33 extending parallel to the P axis. Gripper 9 comprises a front portion for gripping sheet 2, and in turn comprising an end portion 31*a* of plate 31 and an end portion 33*a* of plate 33 at a higher level than portion 31*a*. Close to portions 31*a* and 33*a*, plate 33 pivots on a horizontal pin 34 fitted to plate 31; and portions 31*a* and 33*a* are of reduced thickness to define between them a gap engaged by the edge of sheet 2.

With reference to FIG. 6, device 10 is defined by a fluid actuator housed in body 27 and comprising a piston 35 sliding along a vertical axis inside a chamber 36 formed in body 27 and closed at the top by a portion of plate 28. A rod 37 extends downwards from piston 35 and outwards of chamber 36, and is hinged to an end portion of plate 33 opposite portion 33*a*. The travel of piston 35 inside chamber 36, and hence of rod 37, rotates plate 33 about pin 34 between a position gripping and a position releasing sheet 2.

With reference to FIGS. 2 and 6, plate 28 supports a body 38; and device 11 is defined by a fluid actuator housed in body 38 and comprising a piston 39 sliding, along a horizontal axis parallel to the Y axis, inside a chamber 40 formed in body 38. A rod 42 extends from piston 39 towards slide 7 and outwards of chamber 40, and comprises on the free end a through hole 41 fitted through with pin 26. Two parallel tabs 43 extend downwards from the bottom face of central portion 23 of body 21, and support a pin 44 with an axis parallel to the X axis; and two parallel tabs 45 extend from body 27 towards portion 23 of body 21, and comprise respective through holes 46 fitted through with pin 44.

The travel of piston 39 inside chamber 40, and hence of rod 42, rotates body 27, and hence also gripper 9, about the axis of pin 44. In other words, device 11 provides for adjusting the distance between gripper 9 and worktable 3, and controls the position of gripper 9 with respect to worktable 3 as a function of the work cycle and possibly also of the thickness of sheet 2.

Figure 5:
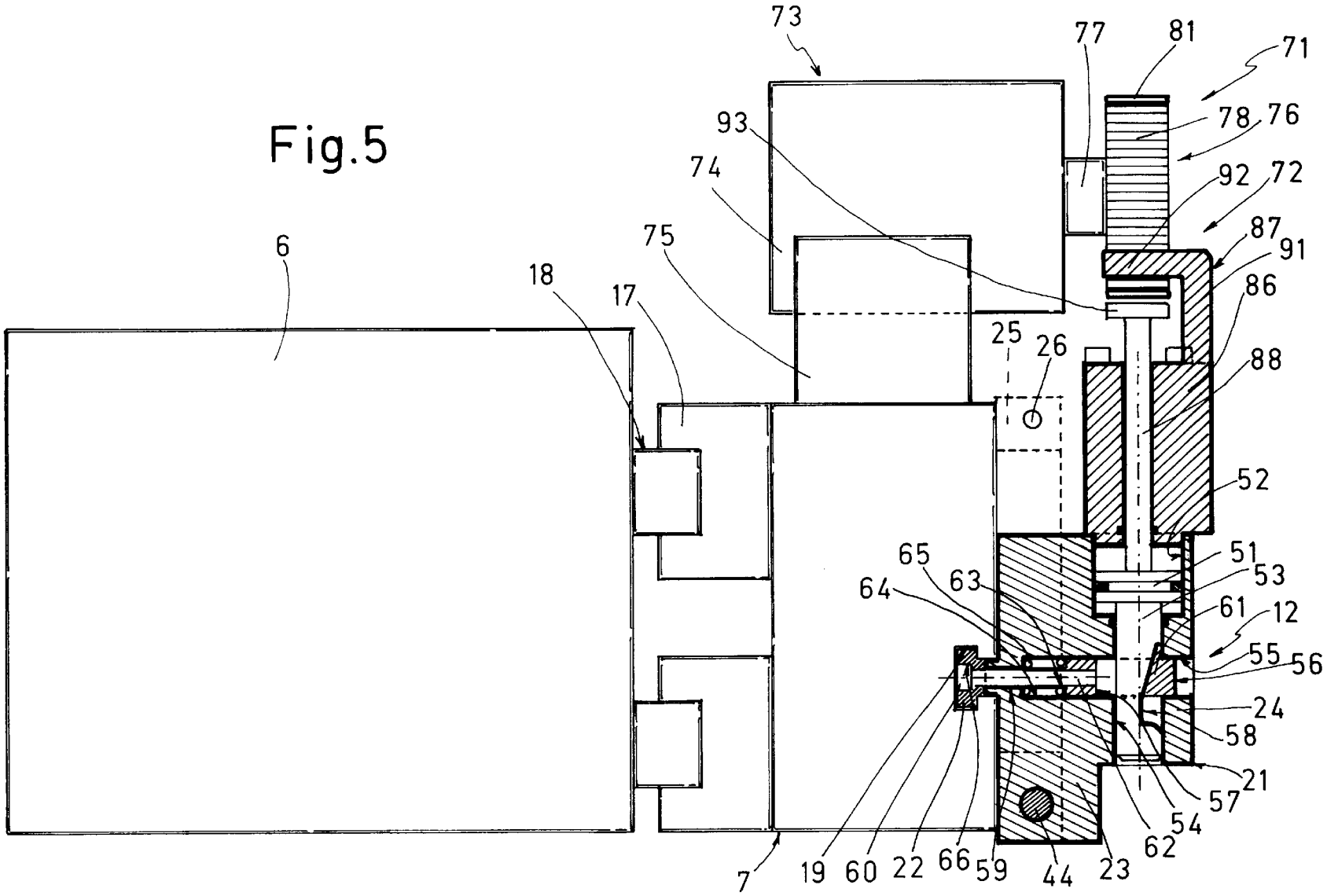
FIG. 5 shows a larger-scale section along line V—V in FIG. 1.

With reference to FIG. 5, device 12 is defined by two fluid actuators housed in respective portions 24 of body 21, and each comprising a piston 51 sliding along a vertical axis inside a chamber 52 formed in portion 24. A rod 53 extends downwards from piston 51, outwards of chamber 52, and inside a vertical hole 54 formed in portion 24. Below chamber 52, each portion 24 comprises a respective cavity 55 open towards the free end of portion 24, and which divides portion 24 into a top and bottom portion, and intersects hole 54. Each cavity 55 houses a respective horizontal plate 56 having a vertical through hole 57 fitted through with rod 53, and plate 56 slides, inside respective cavity 55, to and from slide 7. A central portion of rod 53 comprises a cavity 58 increasing in depth downwards and facing the free end of portion 24; and one edge of hole 57 in plate 56 comprises a projection 61 increasing in thickness downwards, extending towards slide 7, and engaging cavity 58 in rod 53, the thickness of the thickest portion of projection 61 being less than the depth of the deepest portion of cavity 58.

With reference to FIG. 5, bar 22 is made integral with the two plates 56 by two horizontal ties 59, which each comprise a head 60 engaging a respective seat 66 formed in bar 22, and a threaded shank 62, which, through a hole 64 formed in portion 23, engages a threaded hole 63 formed in respective plate 56. A preloaded spring 65 is fitted inside hole 64 to press respective plate 56 outwards of cavity 55. Rod 53 may travel downwards into an extracted position (FIG. 5) in which, by virtue of cavity 58 mating with projection 61, rod 53 pushes plate 56 outwards of cavity 55; and may travel upwards into a withdrawn position in which plate 56 is pushed outwards of cavity 55 by spring 65 only, by virtue of projection 61 being located at the deepest portion of cavity 58. The extracted position of rod 53 provides for clamping gripper assembly 8 to slide 7, by rod 53 pushing plate 56 outwards of cavity 55, so that bar 22, which is connected integral with plate 56 by tie 59, is pressed firmly against the walls of groove 19, thus clamping bar 22 and hence the whole of gripper assembly 8 to slide 7, and so preventing gripper assembly 8 from moving, with respect to slide 7, along an axis parallel to the X axis. The withdrawn position of rod 53 provides for releasing gripper assembly 8 from slide 7, by exerting pressure on gripper assembly 8 in a direction parallel to the X axis and sufficient to overcome the force of spring 65, so that, by virtue of the clearance between bar 22 and groove 19, bar 22, and hence the whole of gripper assembly 8, is permitted to move freely in said direction parallel to the X axis.

With reference to FIGS. 1 and 5, machine 1 comprises a positioning device 71 fitted to slide 7, and for moving gripper assembly 8 with respect to slide 7 along an axis parallel to the X axis, and so positioning gripper assembly 8 as required with respect to slide 7. Device 71 is controlled by central control unit 15, and comprises a device 72 for selecting the gripper assembly 8 to be positioned; drive means 73 for driving the gripper assembly 8 to be positioned; and a device 76 for transmitting motion from means 73 to the gripper assembly 8 to be positioned. Means 73 comprises an electric motor 74 fitted to an axial end portion of slide 7 by means of a bracket 75, and having a drive shaft 77 extending along an axis parallel to the Y axis.

Transmission device 76 comprises a gear 78 fitted to drive shaft 77; an endless toothed belt 81 meshing with gear 78;

and a transmission assembly 82 fitted to slide 7 at the opposite axial end to that supporting motor 74. Transmission assembly 82 comprises a shaft 83 parallel to shaft 77; a bracket 84 fitted to slide 7 and supporting shaft 83; and a gear 85 fitted to shaft 83, meshing with belt 81, and rotating freely about the axis of shaft 83. As shown in FIG. 1, belt 81 therefore extends along the whole length of slide 7 in a direction parallel to the X axis, and is located over portions 24 of gripper assemblies 8.

Figure 3:
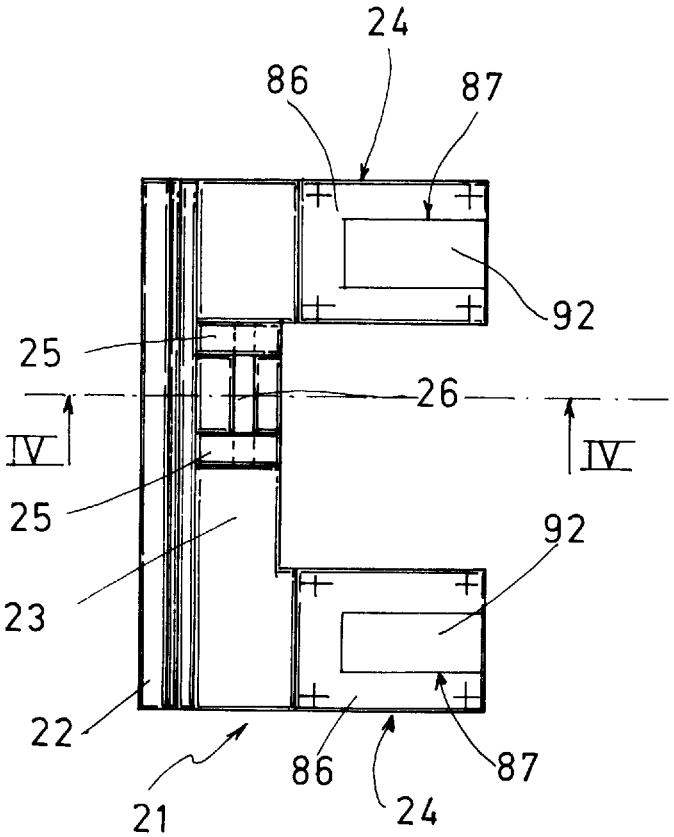
FIG. 3 shows a plan view of a body of the FIG. 2 gripper assembly.

With reference to FIGS. 2, 3 and 5, for each gripper assembly 8, device 72 comprises a body 86 fitted to the upper surface of each portion 24; an upside down L-shaped plate 87 fitted to each body 86; and a rod 88 extending from each piston 51 through and beyond the upper surface of body 86. Plate 87 comprises a vertical portion 91 extending from the lateral edge of the upper surface of body 86 facing station 4; and a horizontal portion 92 extending towards slide 7, and located inside the loop defined by belt 81, at a minimum distance from a bottom portion of belt 81. The axial end of rod 88 outside body 86 comprises a pad 93 parallel to portion 92. More specifically, pad 93 is lower than portion 92 so that a portion of belt 81 extends in between. Rod 88 may assume a first axial position corresponding to the extracted position of rod 53, and wherein pad 93 is detached from belt 81; and a second axial position corresponding to the withdrawn position of rod 53, and wherein pad 93 presses a portion of belt 81 firmly against portion 92. Pad 93 and portion 92 thus define a retaining assembly for retaining gripper assembly 8 to belt 81. When rod 88 is set to the first axial position, the movement of belt 81 causes no movement of gripper assembly 8; when rod 88 is set to the second axial position, the movement of belt 81 causes gripper assembly 8 to move in a direction parallel to the X axis; and the drive shaft 77 of motor 74 may, of course, be rotated clockwise or anticlockwise to move gripper assembly 8 in both directions.

Figure 7:
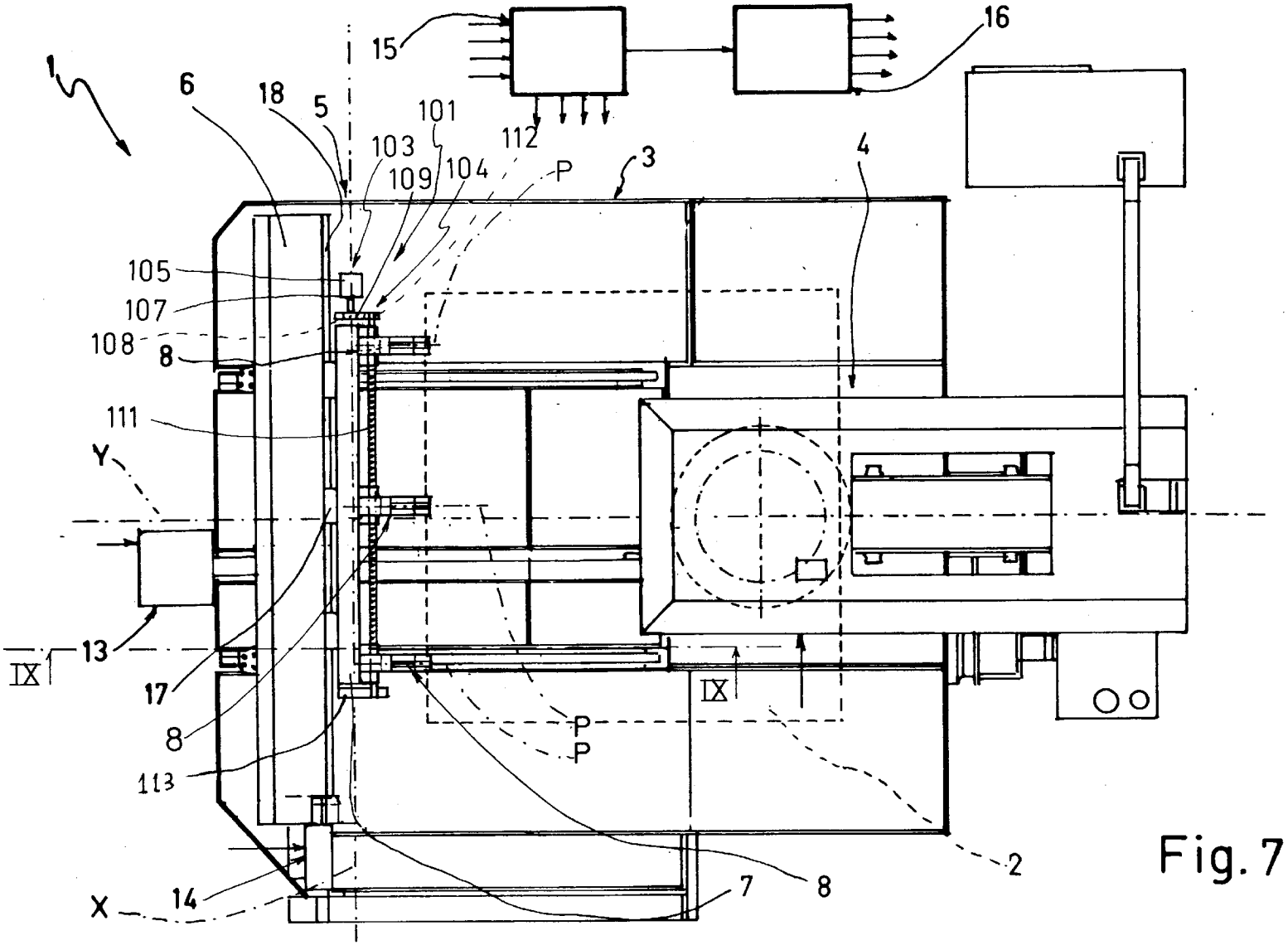
FIG. 7 shows a plan view of a second embodiment of a sheet metal-working machine in accordance with the teachings of the present invention.
Figure 8:
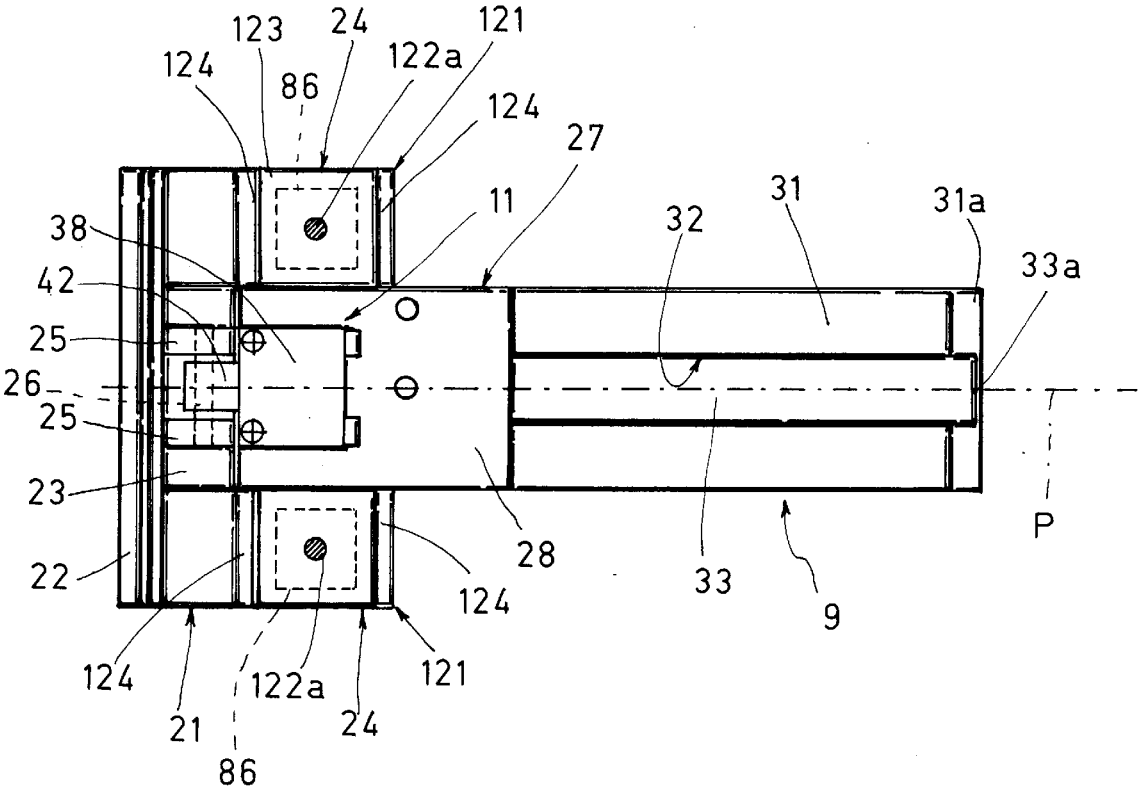
FIG. 8 shows a larger-scale plan view of a gripper assembly of the FIG. 7 machine.
Figure 9:
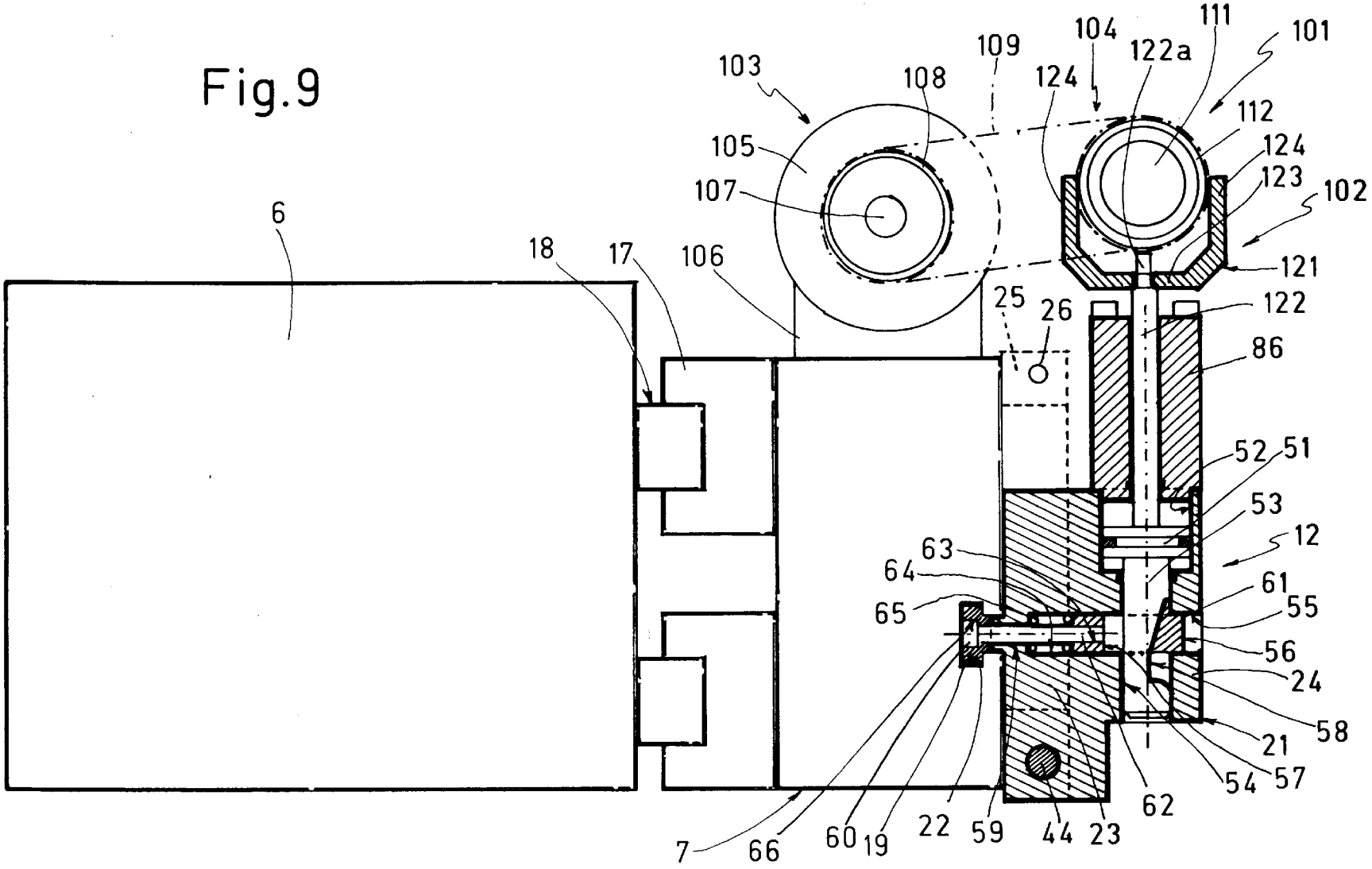
FIG. 9 shows a larger-scale section along line IX—IX in FIG. 7.

FIGS. 7, 8 and 9 show an alternative embodiment to that in FIGS. 1 to 6 for positioning gripper assembly 8 along slide 7, and which, as opposed to device 71, comprises a positioning device 101 fitted to slide 7, controlled by central control unit 15, and which in turn comprises a device 102 for selecting the gripper assembly 8 to be positioned, drive means 103 for driving gripper assembly 8 to be positioned, and a device 104 for transmitting motion from means 103 to gripper assembly 8 to be positioned. Means 103 comprise an electric motor 105 fitted to a first axial end of slide 7 by means of a bracket 106, and having a drive shaft 107 extending along an axis parallel to the X axis.

Transmission device 104 comprises a gear 108 fitted to drive shaft 107; an endless toothed belt 109 meshing with gear 108; a worm screw 111 having an axis parallel to the X axis; a gear 112 fitted to a first axial end of worm screw 111 and meshing with belt 109; and a bracket 113 fitted to a second axial end of slide 7 and supporting a second axial end of worm screw 111. As shown in FIG. 7, worm screw 111 therefore extends along the whole length of slide 7 in a direction parallel to the X axis, and is located over portions 24 of gripper assemblies 8.

With reference to FIGS. 8 and 9, for each gripper assembly 8, device 102 comprises a body 86 fitted to the upper surface of each portion 24; a U-shaped plate 121; and a rod 122 extending from each piston 51 through and beyond the upper surface of body 86, and which supports a respective plate 121 above the upper surface of body 86. Plate 121 comprises a horizontal portion 123 fitted to an axial end portion of rod 122; and two vertical lateral portions 124 on either side of a portion of worm screw 111. An axial end portion **122*a* of rod 122 outside body 86 comprises a threaded surface meshing with the thread of worm screw 111; and the longitudinal axis of rod 122 is coplanar with, but perpendicular to, the longitudinal axis of worm screw 111. Rod 122 may assume a first axial position corresponding to the extracted position of rod 53, and wherein the threaded surface of portion 122*a* is detached from worm screw 111; and a second axial position corresponding to the withdrawn position of rod 53, and wherein the threaded surface of portion 122*a* meshes with worm screw 111**.

When rod 122 is set to the first axial position, rotation of worm screw 111 causes no movement of gripper assembly 8; when rod 122 is set to the second axial position, rotation of worm screw 111 causes gripper assembly 8 to move in a direction parallel to the X axis; and the drive shaft 107 of motor 105 may, of course, be rotated clockwise or anticlockwise to move gripper assembly 8 in both directions.

In actual use, to change the position of a gripper assembly 8 with respect to slide 7—either to work the portion of sheet 2 engaged by gripper assembly 8, or to prevent gripper assembly 8, if located close to station 4, from colliding with a tool, or for any other reason—this is done by simply:

activating device 10 of the gripper assembly 8 to be positioned, so as to open gripper 9 and release sheet 2;

activating devices 12 of gripper assembly 8 to release it from slide 7;

activating said drive means to move gripper assembly 8 into the required position;

activating devices 12 of the positioned gripper assembly 8 to clamp it to slide 7;

activating device 10 to close gripper 9 and engage sheet 2.

When activating devices 12, positioning device 71 provides for simultaneously clamping or releasing belt 81 to or from elements (pad 93 and portion 92 of plate 87) of gripper assembly 8, and so connecting or releasing belt 81 to or from gripper assembly 8, whereas positioning device 101, when activating devices 12, provides for meshing or detaching portion **122*a* and worm screw 111. All the above operations may be performed during the operating cycle of machine 1, i.e. with no need to stop the machine, and are controlled by central control unit 15, which, given the location of gripper assemblies 8 with respect to slide 7, and given the machine cycle, provides for changing the position of one or more gripper assemblies 8 with respect to slide 7**.

The many advantages of the present invention will be clear from the foregoing description. In particular, it provides for a machine capable of positioning the gripper assemblies with respect to the slide in a highly straightforward manner and under control of an electronic central control unit. Moreover, machine 1 features a device for regulating the distance between the gripper and the worktable.

Clearly, changes may be made to machine 1 as described and illustrated herein without, however, departing from the scope of the present invention.

The invention being thus described, it will be obvious that the same may be varied in many ways. Such variations are not to be regared as a departure from the spirit and scope of the invention, and all such modifications as would be obvious to one skilled in the art are intended to be included within the scope of the following claims.

I claim:

1. A sheet metal-working machine comprising:

a worktable on to which a metal sheet is loaded in use;

a work station;

a feed member for feeding said sheet along said worktable to and from said work station; said feed member comprising a carriage movable along a first horizontal axis, a slide fitted to and movable with respect to said carriage along a second horizontal axis perpendicular to said first horizontal axis, and a number of gripper assemblies fitted to said slide and each gripper assembly comprising a gripper for engaging a peripheral edge of said sheet; and a first device of each said gripper assembly for clamping and releasing each said gripper assembly to and from said slide;

a positioning device fitted to said slide and for moving each said gripper assembly with respect to said slide along an axis parallel to said second axis to position each said gripper assembly as required with respect to said slide; said positioning device comprising drive means for driving each said gripper assembly to be positioned, and a second device for transmitting motion from said drive means to each said gripper assembly to be positioned, each said first device includes means for engaging said drive means and movable between a first position in which said engaging means is detached from said drive means and a second position in which said engaging means is connected to drive means; each said first device clamping a respective gripper assembly to said slide when said engaging means assumes said first position, and releasing said gripper assembly from said slide when said engaging means assumes said second position.

2. The machine as claimed in claim 1, wherein said positioning device includes a third device for selecting said gripper assemblies to be positioned.

3. The machine as claimed in claim 2, wherein said drive means includes an electric motor fitted to said slide and having a drive shaft extending along an axis parallel to said first axis; and said second device includes, a gear fitted to said drive shaft, an endless toothed belt meshing with said gear, and a transmission assembly fitted to said slide; said third device includes, for each said gripper assembly, at least one retaining assembly for selectively connecting and detaching said gripper assembly to be positioned and a portion of said belt.

4. The machine as claimed in claim 3, wherein each said retaining assembly includes a horizontal plate integral with said gripper assembly and extending over said portion of said belt; and each said engaging means includes a pad movable between a first position detached from said portion of said belt, and a second position pressing said portion of said belt firmly against said plate.

5. The machine as claimed in claim 4, wherein said first device includes a rod fitted with said engaging means and movable between a first position in which said retaining assembly is detached from said belt, and a second position in which said retaining assembly is connected to said belt; said first device clamping said gripper assembly to said slide when said rod assumes said first position, and releasing said gripper assembly from said slide when said rod assumes said second position.

6. The machine as claimed in claim 5, wherein said first device comprises a fluid actuator for translating said rod.

7. The machine as claimed in claim 2, wherein said drive means includes an electric motor fitted to said slide and having a drive shaft extending along an axis parallel to said second axis; said second device includes a first gear fitted to said drive shaft, an endless toothed belt meshing with said first gear, a worm screw with an axis parallel to said second axis, and a second gear fitted to said worm screw and meshing with said belt; said third device includes, for each said gripper assembly, at least one portion located on said gripper assembly, having said engaging means, said engaging means includes a threaded surface meshing with the thread of said worm screw, and movable between a first position detached from said worm screw, and a second position in which said threaded surface meshes with said worm screw.

8. The machine as claimed in claim 7, wherein said first device comprises a rod having said portion with said engaging means and movable between a first position in which said portion having said engaging means is detached from said worm screw, and a second position in which said portion having said engaging means meshes with said worm screw; said first device clamping said gripper assembly to said slide when said rod assumes said first position, and releasing said gripper assembly from said slide when said rod assumes said second position.

9. The machine as claimed in claim 8, wherein said first device comprises a fluid actuator for translating said rod.

10. The machine as claimed in claim 1, wherein each said gripper assembly includes a first body; guide means between said first body and said slide; a second body supporting said gripper; and a third device for rotating said second body about a horizontal axis parallel to said second axis.

11. The machine as claimed in claim 10, wherein said first body supports said first device and said third device.

12. The machine as claimed in claim 1, further comprising an electronic central control unit for controlling said work station, said feed member, said first device, and said positioning device.

* * * * *